US005488399A

United States Patent [19]

Mitomi et al.

[11] Patent Number: 5,488,399

[45] Date of Patent: Jan. 30, 1996

[54] BELT DRIVING APPARATUS AND IMAGE RECORDING APPARATUS USING THE SAME

[75] Inventors: Tatsuo Mitomi; Tomohiro Aoki, both of Yokohama; Yasushi Murayama, Tokyo; Takashi Uchida, Yokohama; Tohru Kobayashi, Tokyo; Masatoshi Ikkatai, Kawasaki; Masaharu Nemura, Yokohama, all of Japan

[73] Assignee: Canon Kabushiki Kaisha, Tokyo, Japan

[21] Appl. No.: 497,999

[22] Filed: Jun. 7, 1995

Related U.S. Application Data

[63] Continuation of Ser. No. 347,175, Nov. 22, 1994, abandoned, which is a continuation of Ser. No. 225,002, Apr. 7, 1994, abandoned, which is a continuation of Ser. No. 774,355, Oct. 10, 1991, abandoned.

[30] Foreign Application Priority Data

Oct. 12, 1990 [JP] Japan ..... 2-273818

[51] Int. Cl.[6] ..... B41J 2/21; B41J 2/385; G03G 15/01

[52] U.S. Cl. ..... 347/43; 347/118; 355/327

[58] Field of Search ..... 355/212, 272, 355/327, 326 R, 317, 211; 347/43, 118; 400/120.01, 120.02

[56] References Cited

U.S. PATENT DOCUMENTS 4,531,828 7/1985 Hoshino ..... 355/272 X
4,884,105 11/1989 Joseph et al. ..... 355/212

FOREIGN PATENT DOCUMENTS 376345 7/1990 European Pat. Off. .
59-182139 10/1984 Japan .

*Primary Examiner*—A. T. Grimley
*Assistant Examiner*—Shuk Y. Lee
*Attorney, Agent, or Firm*—Fitzpatrick, Cella, Harper & Scinto

[57] ABSTRACT

A belt driving apparatus for carrying material to be recorded to a plurality of image recording units. In the belt driving apparatus, the distance of movement of material to be recorded corresponding to one rotation of the belt driving roller has been set to n (an integer)-times (where n=2, 3, 4 . . . ) as long as a distance between each image recording unit. A distance between one image recording unit and another recording unit is equal to or an integral fraction of π(D+2 t), wherein D is the diameter of a drive roller driving the belt and t is the thickness of the belt.

27 Claims, 5 Drawing Sheets

BELT DRIVING APPARATUS AND IMAGE RECORDING APPARATUS USING THE SAME

This application is a continuation of application Ser. No. 08/347,175 filed Nov. 22, 1994, now abandoned, which was a continuation of application Ser. No. 08/225,002 filed Apr. 7, 1994, now abandoned, which was a continuation of application Ser. No. 07/774,355 filed Oct. 10, 1991, now abandoned.

BACKGROUND OF THE INVENTION

1. Field of the Invention

This invention relates to a carrying belt driving apparatus for carrying sheet-shaped recording material with a carrying belt and, more particularly to a carrying belt driving apparatus for successively carrying recording material to a plurality of image recording units and an image recording apparatus using the same.

2. Related Background Art

In a conventional carrying belt apparatus, sheet-shaped transfer material such as ordinary paper is electrostatically attracted to the carrying belt for carrying. In a conventional color printer apparatus, in which a color image based on multiple transfer image is formed on sheet-shaped transfer material by allowing a plurality of transfer units in image forming means to successively pass, the sheet-shaped transfer material is carried with the carrying belt for multiple transfer in each transfer unit. Therefore, an image displacement is greatly controlled by consistency of movement of the carrying belt, and after all, a high roundness is required for a driving roller to drive the carrying belt, and at the same time, a high rotational speed is also required for a gear train which interlocks the driving roller.

For this reason, such an apparatus as shown in FIG. 1 has been proposed so far (prior application by Canon Inc., Japanese Patent Laid-Open Application No. 59-182139 official gazette).

This conventional apparatus comprises four sets of electrophotographic laser beam printer mechanism included as a plurality of sets of image forming mechanisms. That is, in FIG. 1, numeral 1 is a main body box of the apparatus, and numerals I, II, III and IV show four sets: the 1st to the 4th of laser beam printer mechanisms (hereinafter called simply "printer mechanism") which have been successively disposed from the right to the left in FIG. 1 within the main body box 1.

Belt driving rollers 3 and 4 have been disposed diagonally to the lower right of the 1st printer mechanism, and diagonally to the lower left of the 4th printer mechanism IV respectively, and are driven by a driving source (not shown). A screen belt 2 for carrying the transfer material is wound around the belt driving rollers 3 and 4. This screen belt 2 is made of Tetron fiber mesh, and is moved in the arrow direction shown in FIG. 1 by the driving rollers 3 and 4. A paper feed mechanism 5 has been disposed on the right side of the apparatus frame, and an image fixer 6 on the left end side thereof. Numeral 7 is a discharge port outside the printer.

Each printer mechanism I to IV are substantially the same in mechanism constitution itself. That is, each printer mechanism is composed of a drum type electrophotographic photosensitive body 9 (hereinafter simply called "drum") as an image bearing body which is driven around a shaft 8 in the arrow direction, a charger 10, a developer 11, a transfer charger 12 and a cleaner 13 which have been successively disposed around the drum 9 in the direction of rotation thereof, a laser beam scanner 14 disposed above the drum 9, and the like.

The laser beam scanner 14 is composed of a semiconductor laser, a polygon mirror, an f-θ lens, a light shielding plate, etc., and receives the input of an electric digital pixel signal S of time series to be calculated and output by an image reading apparatus (not shown) and an electronic computer to oscillate a laser beam L modulated in accordance with the signal, and to expose the drum surface by scanning a drum surface portion between the charger 10 and the developer 11 in the drum generatrix direction.

However, yellow (Y) developing toner is kept in a developer 11 of the first printer mechanism I, magenta (M) developing toner is kept in that of the second printer mechanism, cyan (C) developing toner in that of the third printer mechanism, and black (BK) developing toner in that of the fourth printer mechanism respectively.

A pixel signal S (Y) corresponding to a yellow component image of color image is input into a laser beam scanner 14 of the 1st printer mechanism I, a signal S (M) corresponding to a magenta component image is input into that of the 2nd printer mechanism II, a signal S (C) corresponding to a cyan component 10 image into that of the 3rd printer mechanism III, and a signal S (BK) corresponding to a black component image into that of the 4th printer mechanism IV respectively.

When power is turned on for the apparatus, current is flown through the laser beam scanners 14 for each printer mechanism I to IV and other required process equipment or these are driven, and current is flown through the heater for a fixer 6 to cause the apparatus to perform warming-up operation. When the laser lights, the scanner reaches a predetermined number of revolutions, and the fixing roller reaches a predetermined temperature, this printer apparatus is ready for operation.

When cut sheet-shaped transfer sheet P as transfer material is inserted on a paper feed guide 51 of the paper feed mechanism 5, its tip end is detected by a first photointerrupter 52 to transmit a start signal (start signal of print sequence). This start signal starts to rotate the drum, 9 for each printer mechanism I to IV. The driving rollers 3 and 4 are also driven at the same time to start running the screen belt 2 in the arrow direction.

The transfer sheet P is fed on the screen belt 2 through paired registers 53, a paper feed guide 55, paired registers 56 and a paper feed guide 57. The transfer sheet P on the screen belt 2 receives corona discharge from a charger for attraction 59 to be securely attracted to the screen belt 2. A guide 58, a conductor, is provided as a counter electrode at this charger 59, and this counter electrode 58 is specially effective if grounded.

Further when the tip end of the transfer sheet P interrupts each photointerrupter 60Y, 60M, 60C and 60BK on the downstream side, its signal successively starts forming of an image for each drum 9, which has been rotating beforehand, of each printer mechanism I to IV.

That is, an yellow image as color component of color image is assigned to the drum 9 surface of the 1st printer mechanism, the same magenta image to that of the 2nd mechanism II, the same cyan image to that of the 3rd mechanism III, and the same black image to that of the 4th mechanism IV for being formed respectively. Since the principle of forming an image in each printer mechanism has been already known well as Carlson process, its description is omitted.

Rotation of the screen belt 2 allows the transfer sheet P to successively pass the lower portion of the 1st to 4th printer mechanisms I to IV toward the fixer 6 for being carried. In the process of passage in each mechanism unit, a yellow image formed on the drum 11 surface of the 1st printer mechanism I, the same magenta image on that of the 2nd mechanism II, the same cyan image on that of the 3rd mechanism III and the same black image on that of the 4th mechanism IV are successively piled up and transferred on the surface of the transfer sheet by a charger for transfer 12 of each mechanism unit to synthetically form a color image on the surface of the sheet. After the transfer sheet passes the 4th printer mechanism IV, it is de-electrified by a deelectrifier 61, to which AC voltage has been applied, and is separated from the screen belt 2 without causing a discharge mechanism.

The transfer sheet P gets on a separating pawl 61*a*, enter the fixer 6, the image is fixed through color toner formed thereon, and the sheet is discharged outside the apparatus through an outlet 7 as a color image print. After the transfer sheet P is discharged outside the apparatus, all rotations except the fixer are stopped to complete one print cycle.

To detect the tip end of the above-mentioned transfer sheet P, each photointerrupter 60Y, 60M, 60C and 60BK has been disposed between each mechanism on the path of movement of the screen belt 2 toward the 1st to 4th printer mechanism I to IV on the upstream side of each transfer unit, and plays a role to determine a timing of starting image formation for each mechanism by detecting successive passage of the transfer sheet P through each mechanism unit. Tension rollers 62 and 63 give a tension to the screen belt 2, and the tension roller 62 is rotatable, but its position is fixed. On the other hand, the tension roller 63 is rotatable and also rockable in the arrow direction.

In such a conventional apparatus, the screen belt 2 is driven with a frictional force by the driving roller 4. This driving roller 4 is constructed so that its circumference is equal to an interval between each transfer station (a distance of the screen belt between each transfer station) H. That is, assuming the diameter of the driving roller 4 to be D, it has a relationship of $\pi D=H$.

If the driving roller 4 has an eccentricity, etc. due to processing, assembly, and the like in this case, the moving speed of the screen belt 2 does not become constant, but changes like a sine curve as shown in FIG. 2. According to the constitution of the above prior art, however, the period $T_1$ of the above-mentioned sine wave coincides with a duration in which the transfer sheet P on the screen belt 2 moves from one transfer station to the next transfer station. The amounts of expansion and shrinkage of an image transferred by two transfer stations (2nd and 3rd printer mechanisms II and III) at this time are plotted as shown in FIG. 3.

That is, the transfer position of the image changes like a sine curve as compared with the ideal transfer position, but the phase of the sine wave of an image to be transferred also coincides always because the phase angle of the eccentricity of the driving roller 4 at a position of starting the transfer for each color is always fixed. For this reason, no relative color drift for each color on the image occurs.

However, it has become necessary in recent years to shorten a distance between each image recording unit with miniaturization and weight reduction of a printer apparatus. As a result, in such a conventional belt driving apparatus as mentioned above, the diameter of the belt driving roller must be also made smaller when the distance between the image forming stations for each color is shortened. Assuming the distance between each station to be, for example, 20 mm, the diameter of the driving roller becomes about 6.3 mm. Since, however, the contact area between the driving roller and the belt is considerably small in this case, a problem in which the belt cannot be surely carried, and further a problem in which the belt driving apparatus has an insufficient strength because the shaft diameter is small have occurred.

SUMMARY OF THE INVENTION

It is an object of the present invention to solve these points, and provide a new, improved belt driving apparatus.

It is a further object of the present invention to provide a recording material carrying belt driving apparatus which does not cause any displacement for each color on the image even if any speed fluctuation occurs in the carrying belt by setting the distance of movement of the recording material (or medium) corresponding to one rotation of the belt driving roller to n (an integer)-times (where n=2, 3, 4 . . . ) as long as a distance between each image recording unit.

It is also an object of the present invention to provide an image recording apparatus, comprising a plurality of image recording units, and an installation unit for installing a belt driving apparatus in which the distance of movement of material to be recorded corresponding to one rotation of the belt driving roller has been set to n (an integer)-times (where n=2, 3, 4 . . . ) as long as a distance between each image recording unit.

DESCRIPTION OF THE PREFERRED EMBODIMENTS

Figure 1:
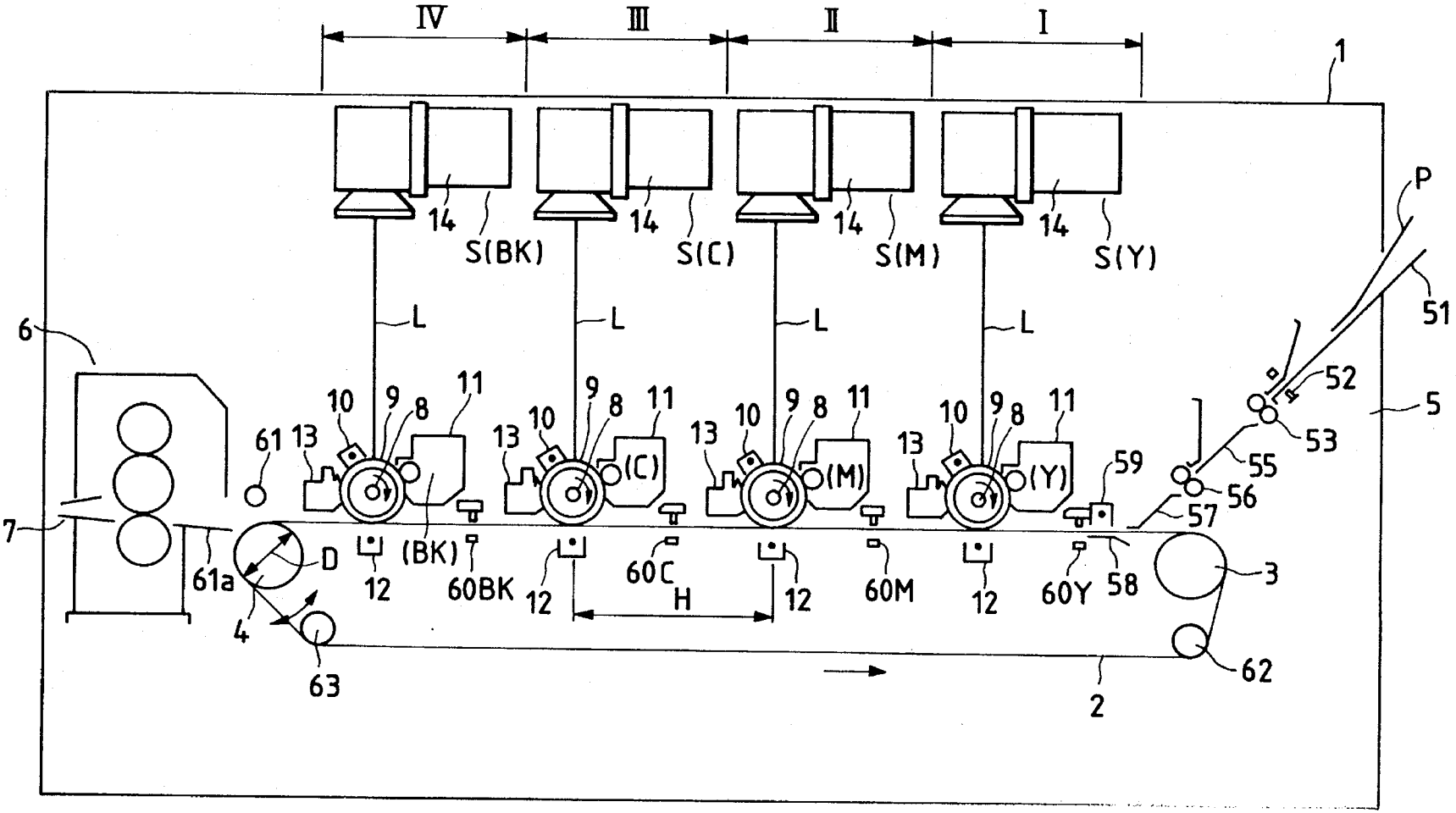
FIG. 1 is a typical section view showing a conventional embodiment of an image forming apparatus.
Figure 2:
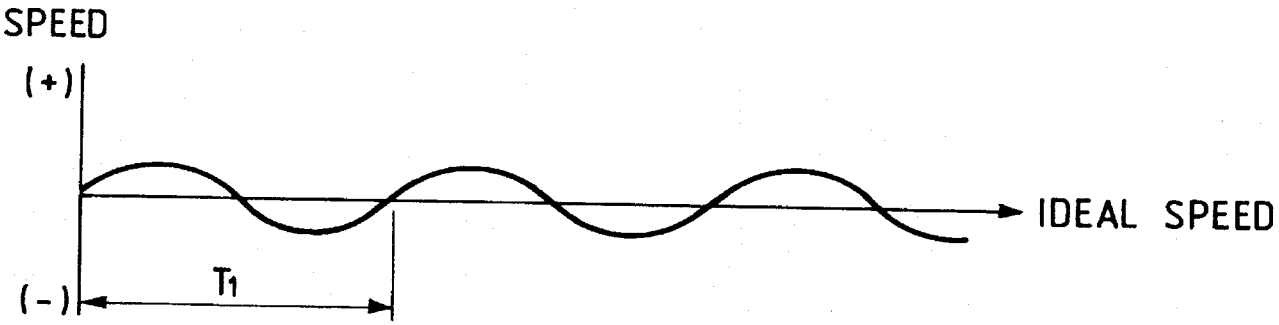
FIG. 2 is a view showing changes in belt speed in a conventional embodiment.
Figure 3:
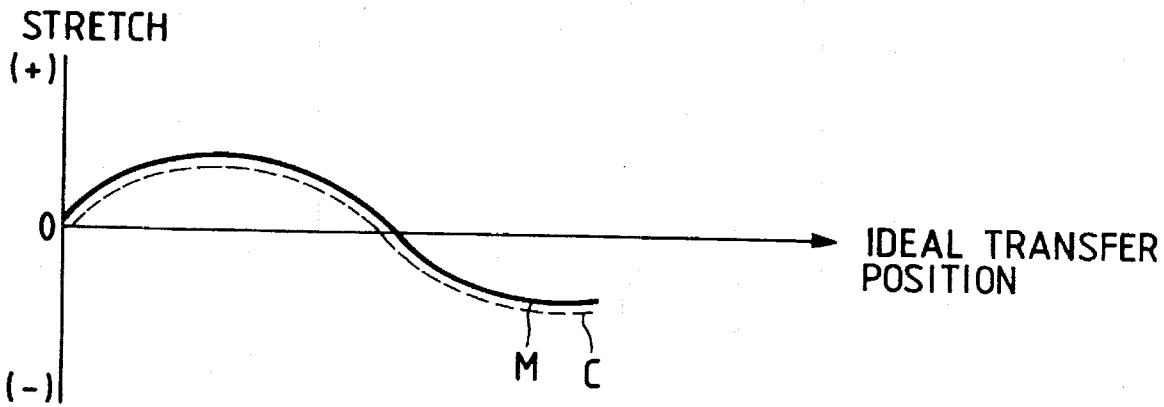
FIG. 3 is a view showing expansion change in a transfer image in the conventional embodiment.

Embodiments according to the present invention will be described below referring to the drawings.

Figure 4:
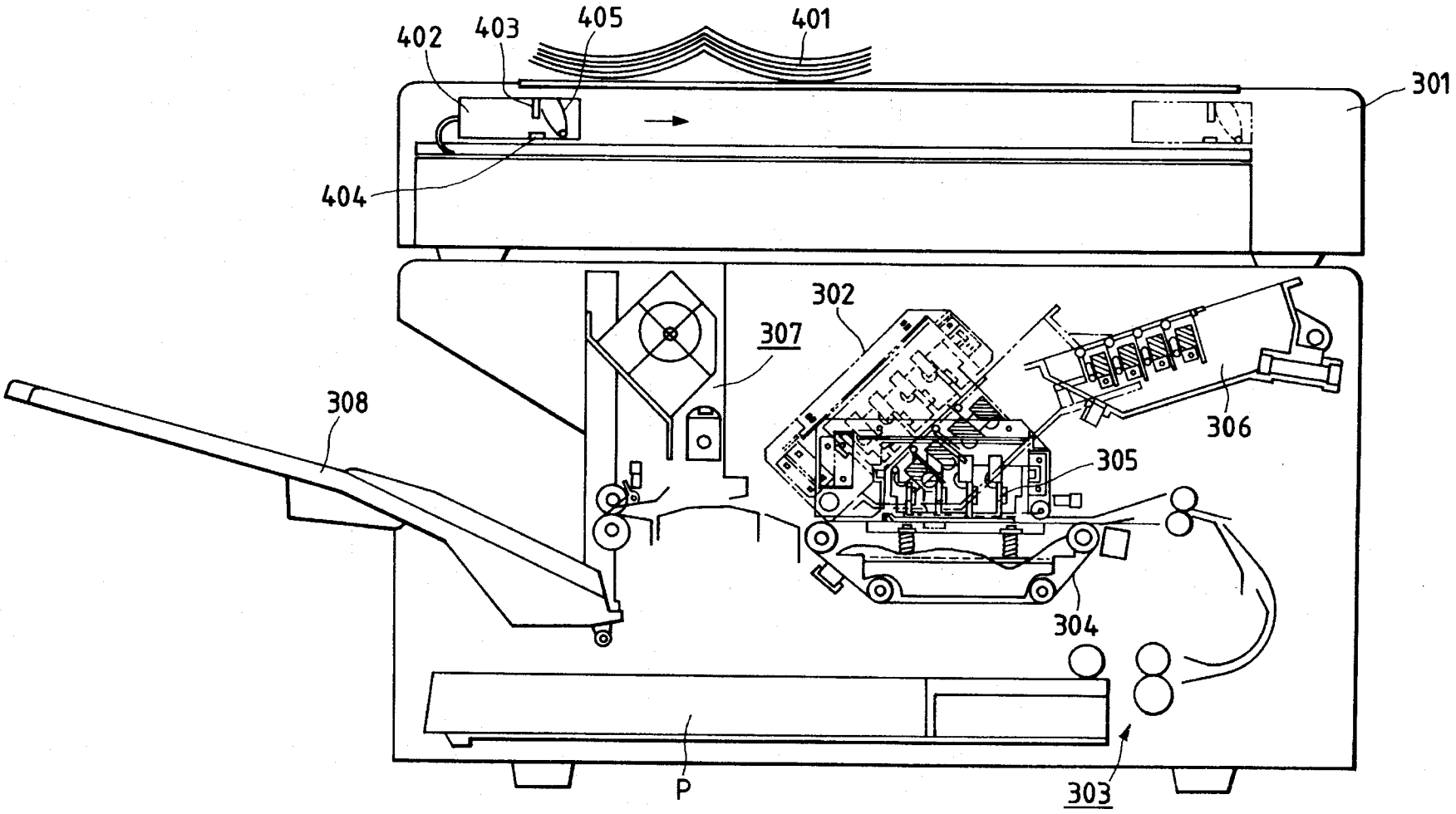
FIG. 4 is a typical section view showing an ink jet recording apparatus to which an embodiment according to the present invention is applied.

FIG. 4 is a typical section view of an ink jet recording apparatus according to an embodiment of the present invention. In FIG. 4, a scanner unit 301 reads an original to convert it into an electric signal. The signal is transmitted to a recording head unit 305 of a printer unit 302 as a driving signal. In a paper feed unit 303, recording sheet P such as ordinary paper and coated paper is housed, and at the same time, one sheet each is fed out toward a belt carrying unit 304 at a time when necessary.

When the recording sheet is passing the above-mentioned belt carrying unit 304, the recording head unit 305 records the recording image on the recording sheet, which is then fed out to a tray 308 through a fixing paper discharge unit 307.

A recovery capping unit 306 functions to maintain the recording head unit 305 in a state of being able to record always.

The respective constitutions will be described in detail below.

Figure 5:
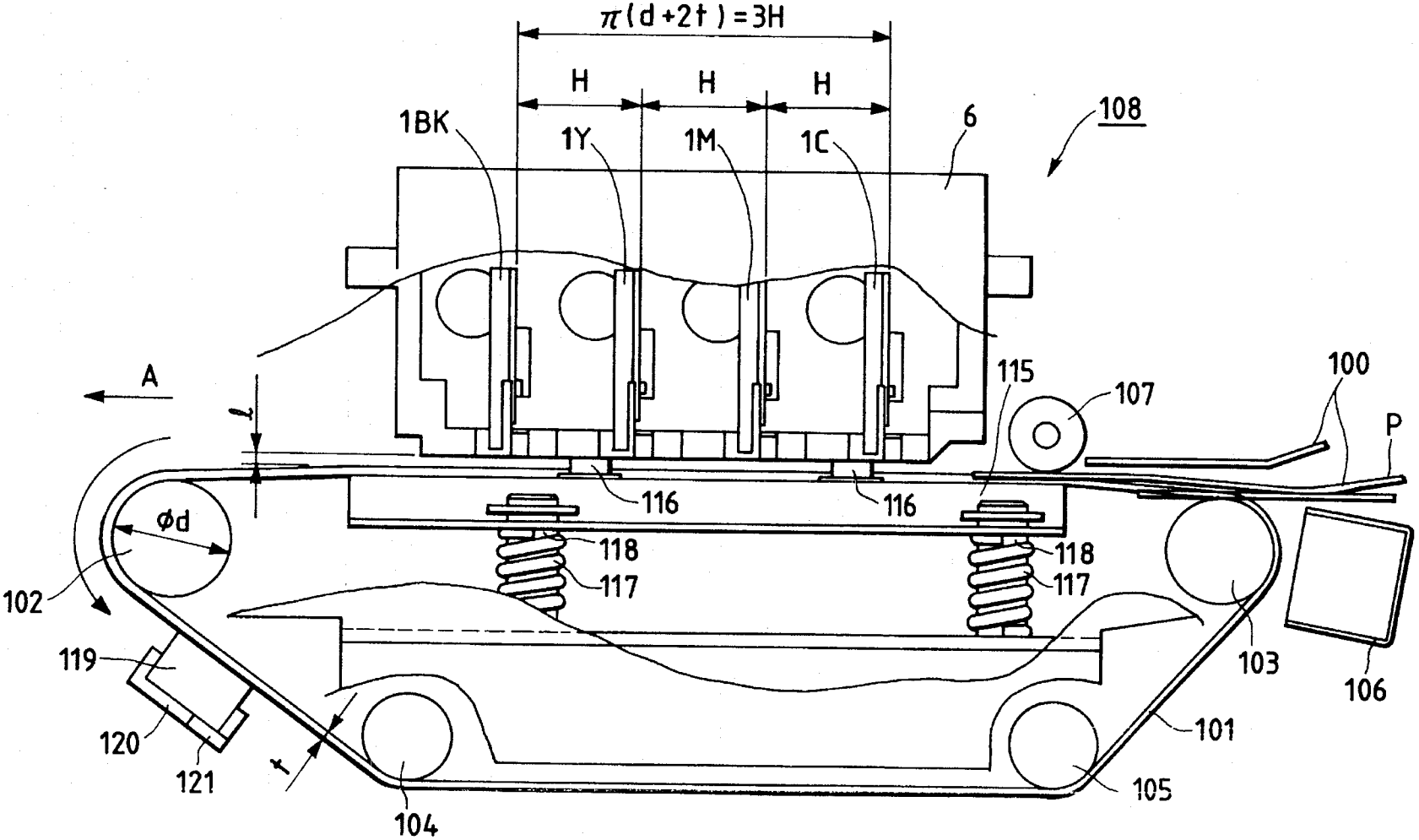
FIG. 5 is a typical section view showing an embodiment of a belt driving apparatus of an embodiment according to the present invention.

FIG. 5 shows the outline of recording sheet carrying means used in an embodiment.

In FIG. 5, the recording sheet P from the regist roller is carried along a guide plate 100 to reach a carrying belt 101. The carrying belt 101 consists of two layers: an insulated layer $10^{12}$ Ωcm or more in volume resistivity on the recording sheet P placement side, and a conducting layer $10^{8}$ Ωcm or less in volume resistivity on the opposite side.

This carrying belt 101 is wound around a driving roller 102, a follower roller 103, and tension rollers 104 and 105, and is loaded with a tension of 2 to 5 Kg. The carrying belt 101 is moved in the arrow A direction in FIG. 5 by a motor (not shown) connected with the driving roller 102.

The recording sheet P is placed on the carrying belt 101 just in front of a conducting roller 107. At this time, the surface of the carrying belt 101 has been provided with a potential of hundreds to thousands V by a charger 106. When the recording sheet P placed on the carrying belt 101 reaches the grounded conducting roller 107, an electrostatic attracting force occurs between the recording sheet P and the carrying belt 101, and the recording sheet closely adheres to the carrying belt 101 for moving.

In this state, the recording sheet reaches a recording unit 108. The recording unit 108 is composed of a head block 6, recording heads 1C, 1M, 1Y and 1BK, a platen 115, pins 116, a spring 117 and guide pins 118. In this portion, it is necessary to keep an interval between the recording heads 1C, 1M, 1Y and 1BK and the recording surface on the recording sheet to a certain preset value at an accuracy of about 100 μm.

For this reason, the flatness of the plane of a platen 115 in contact with the carrying belt 101 is kept at about several tens μm so that the carrying belt 101 forms a plane in the recording unit 108. Also the recording heads 1C, 1M, 1Y and 1BK are positioned to the head block 6 so that the flatness of a plane, which is formed by orifice surface for all the heads, is about several tens μm.

Pins 116 for positioning are installed to the platen 115. If the platen 115 is pressed upward toward the head block 6 by the resiliency of a spring 117 with guide pins 118 as the guide in the above state, the top of the pin 116 strikes against the head block 6 to provide a clearance 1 for passage of the recording sheet. When the recording sheet is carried in such a constitution, the consistency of a distance between the recording surface on the recording sheet and the orifice surface of each head at the recording unit 108 can be kept at about 100 μm to the preset value because the recording sheet closely adheres to the carrying belt 101 with the electrostatic attracting force.

Then the recording sheet passes this recording unit 108, and images of each color are successively recorded on the recording sheet by the recording heads 1C, 1M, 1Y and 1BK. When the speed fluctuation of the carrying belt 101 is great at this time, the recording positions by each head slip to cause color drift and color shading on the color image. To prevent these, the consistency of thickness of the carrying belt 101, the deflection of the outside diameter of the driving roller 102, the consistency of rotation of the driving motor, etc. are determined to sufficiently reduce the speed fluctuation of the carrying belt 101.

The recording sheet recorded in the recording unit 108 reaches the driving roller 102 while it remains closely adhering to the carrying belt 101, where the recording sheet is separated from the carrying belt 101 owing to the curvature for being fed to the fixing unit.

Thereafter, the surface of the carrying belt 101 is cleaned by a cleaner 120 equipped with an ink absorber 119. The ink absorber 119 is made of a continuous porous member such as polyvinyl formal resin, and the absorbed ink is flown to the outside through an opening 120 for being collected.

Human visual sensation generally feels that a color strikingly contrastive with white is a conspicuous color. The colors used in this embodiment are four colors: cyan (C), magenta (M), yellow (Y) and black (BK), and these have more intensive contrast with white in the order of BK, C, M and Y. For this reason, if the recording sheet is white, color drift of BK and C or color drift of BK and M is especially conspicuous.

Therefore the belt driving apparatus of the above embodiment is constructed so that the distance of movement of the recording sheet corresponding to one rotation of the belt driving roller 102 is equal to an interval 3 H between the BK head 1BK and the C head 1C in FIG. 5. That is, assuming the diameter of the belt driving roller 102 to be d, and the belt thickness to be t, it is set to have a relationship of $\pi(d+2t)=3H$.

If the driving roller has an eccentricity, etc. due to processing, assembly, and the like in this case, the moving speed of the recording sheet on the carrying belt 102 does not become constant, but the belt speed changes like a sine curve. According to the constitution of this embodiment, however, the period of the above sine wave coincides with a duration in which the recording sheet on the carrying belt moves from a head for cyan ink 1C to a head for black ink 1BK.

That is, the image recording position changes like a sine curve as compared with the ideal recording position, but the phase angle for eccentricity of the driving roller at the position for starting the recording of black and cyan is always fixed. Therefore, color drift of BK and cyan does not substantially occur on the image.

Figure 6:
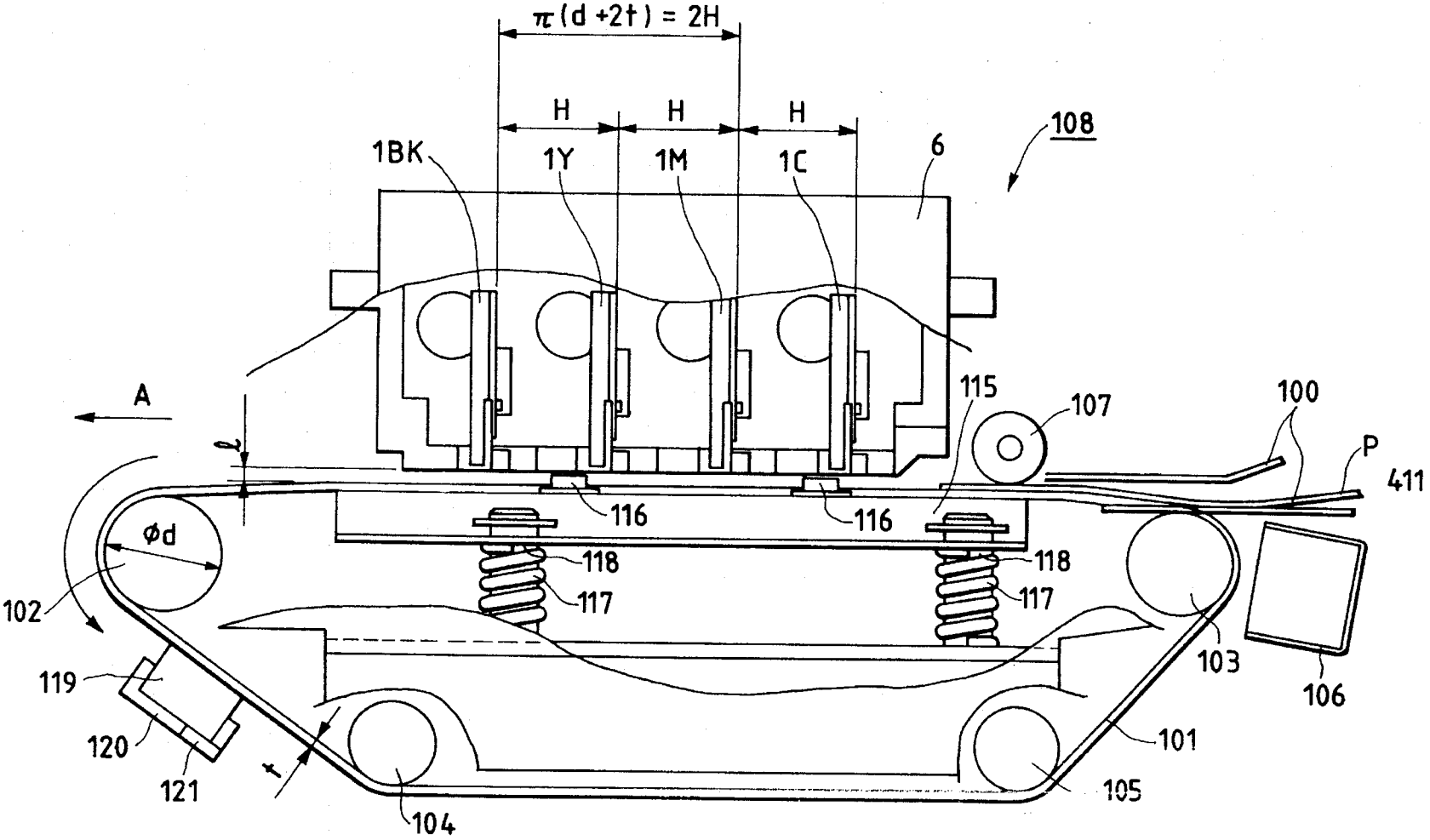
FIG. 6 is a typical section view showing another embodiment of a belt driving apparatus of an embodiment according to the present invention.

Another embodiment using the same constitution of the belt carrying means as in FIG. 5 is shown in FIG. 6. In FIG. 6, the same component members as in FIG. 5 are affixed with the same symbols for description.

As shown in FIG. 6, the belt driving apparatus of the above embodiment has been constructed so that the distance of movement of the recording sheet corresponding to one rotation of the belt driving roller 102 is equal to an interval 2 H between the BK head 1BK and the M head 1M, that is, to have a relationship of $\pi(d+2t)=2H$. Even if the belt speed has fluctuations, relative color drift of black (BK) and magenta (M) on the image can be thereby ensured not to occur in the same manner as in the above embodiment.

According to the constitution of the present embodiment as described above, black, which is specially conspicuous, can be coincided with another color on an image in color drift even if the carrying belt has speed fluctuations.

What is claimed is:

1. A recording medium conveying apparatus for use in an image recording apparatus for recording an image of plural different colors onto a recording medium by each of a plurality of image recording mechanisms disposed at an image recording area, said conveying apparatus comprising;

an endless conveying member having thickness t for conveying the recording medium;

a first image recording position disposed at said image recording area, at said first image recording position the recording medium being recorded with a first color of said plural colors, the first color having a high contrast to a recording surface of the recording medium;

an adjacent second image recording position disposed at said image recording area, at said second image recording position the recording medium being recorded with a second color of said plural colors, the second color having a lowest contrast to a recording surface of the recording medium; and a drive roller member having diameter D for driving said endless conveying member, wherein a distance between said first image recording position and another image recording position which records in a third color of intermediate contrast is equal to $\pi(D+2\ t)$.

2. A recording medium conveying apparatus according to claim 1, wherein a distance between the first and second image recording positions is equal to an integral fraction of $\pi(D+2\ t)$.

3. A recording medium conveying apparatus according to claim 1, wherein said first color is black.

4. A recording medium conveying apparatus according to claim 1, wherein said second color is yellow.

5. A recording medium conveying apparatus according to claim 1, wherein said third color is cyan.

6. A recording medium conveying apparatus according to claim 1, wherein said third color is magenta.

7. A recording medium conveying apparatus according to claim 1, wherein each said image recording mechanism has an attaching portion for attaching an ink jet recording head for discharging ink from a discharge port to record.

8. A recording medium conveying apparatus according to claim 7, wherein said ink jet recording head has an electrothermal converting element for generating energy for discharging ink from the discharge port to record.

9. An image recording apparatus for recording an image on a recording medium comprising:

an endless conveying member having thickness t for conveying the recording medium;

a plurality of image recording mechanisms disposed along a conveyance route of the recording medium conveyed by said endless conveying member to record an image on the recording medium, each said image recording mechanism recording an image with a color different from other of said image recording mechanisms; and a drive roller member having diameter D for driving said endless conveying member, wherein a distance between a first recording position at which the recording medium is recorded with a first color having a high contrast to a recording surface of the recording medium and a second image recording position at which the recording medium is recorded with a second color having a lower contrast to a recording surface of the recording medium is equal to $\pi(D+2\ t)$, and wherein the first recording position is adjacent a recording position at which the recording medium is recorded with a color having a lowest contrast to a recording surface of the recording medium.

10. A recording medium conveying apparatus according to claim 9, wherein a distance between the first recording position and the adjacent recording position is equal to an integral fraction of $\pi(D+2\ t)$.

11. A recording medium conveying apparatus according to claim 9, wherein said first color is black.

12. A recording medium conveying apparatus according to claim 9, wherein said second color is cyan.

13. A recording medium conveying apparatus according to claim 9, wherein said second color is magenta.

14. A recording medium conveying apparatus according to claim 9, wherein said color of lowest contrast is yellow.

15. A recording medium conveying apparatus according to claim 9, wherein each said image recording mechanism has an attaching portion for attaching an ink jet recording head for discharging ink from a discharge port to record.

16. A recording medium conveying apparatus according to claim 15, wherein said ink jet recording head has an electrothermal converting element for generating energy for discharging ink from the discharge port to record.

17. A color image printing apparatus for printing a color image on a print medium comprising:

an endless conveying member having thickness t for conveying the print medium;

a plurality of ink jet print mechanisms disposed along a conveyance route of the print medium conveyed by said endless conveying member to print a color image on the print medium, each said ink jet print mechanisms printing the color image with a color different from other of said ink jet print mechanisms; and a drive roller member having diameter D for driving said endless conveying member, wherein a distance between a first image print position at which the print medium is printed with a first print color having a highest contrast to a print surface of the print medium and a second image print position at which the print medium is printed with a second print color having a lower contrast to the print surface of the print medium is equal to $\pi(D+2\ t)$, and wherein the first image print position is adjacent an image print position at which the print medium is printed with a color having a lowest contrast to a print surface of the print medium.

18. A recording medium conveying apparatus according to claim 17, wherein a distance between the first image print position to the adjacent image print position is equal to an integral fraction of $\pi(D+2\ t)$.

19. A recording medium conveying apparatus according to claim 17, wherein said first color is black, said second color is cyan and the color having lowest contrast is yellow.

20. A recording medium conveying apparatus according to claim 17, wherein said first color is black, said second color is magenta and the color having lowest contrast is yellow.

21. A recording medium conveying apparatus according to claim 17, wherein each said ink jet print mechanism has an electrothermal converting element for generating energy for discharging ink from a discharge port to record.

22. A recording medium conveying apparatus for use in an image recording apparatus for recording an image of plural different colors onto a recording medium by each of a plurality of image recording mechanisms disposed at an image recording area, said conveying apparatus comprising:

an endless conveying member having thickness t for conveying the recording medium;

a first image recording position disposed at said image recording area, at said first image recording position the recording medium being recorded with a first color of said plural colors, the first color having a high contrast to a recording surface of the recording medium;

a second image recording position disposed at said image recording area, at said second image recording position the recording medium being recorded with a second color of said plural colors, the second color having a low contrast to a recording surface of the recording medium; and a driver roller member having diameter D for driving said endless conveying member, wherein a distance between said first image recording position and the second image recording position is equal to $\pi(D+2\ t)$.

23. An image recording apparatus for recording an image on a recording medium comprising:

an endless conveying member having thickness t for conveying the recording medium;

a plurality of image recording mechanisms disposed along a conveyance route of the recording medium conveyed by said endless conveying member to record an image on the recording medium, each said image recording mechanism recording an image with a color different from other of said image recording mechanisms; and a drive roller member having diameter D for driving said endless conveying member, wherein a distance between a first recording position at which the recording medium is recorded with a first color having a high contrast to a recording surface of the recording medium and a second image recording position at which the recording medium is recorded with a second color having a low contrast to a recording surface of the recording medium is equal to $\pi(D+2\ t)$.

24. A recording medium conveying apparatus for use in an image recording apparatus for recording an image on a conveying recording medium by a plurality of image recording mechanisms disposed at an image recording area, said apparatus comprising:

an endless recording medium conveying member for conveying the recording medium, said conveying member having a surface for mounting the recording medium and a thickness t;

a first image recording position disposed at an image recording area;

a second image recording position disposed at the image recording area; and a drive roller member for driving said endless recording medium conveying member, said drive roller member having a diameter D, wherein a distance between the first and second image recording positions is equal to $\pi(D+2\ t)$.

25. A recording medium conveying apparatus for use in an image recording apparatus for recording an image on a conveying recording medium by a plurality of image recording mechanisms disposed at an image recording area, said apparatus comprising:

an endless recording medium conveying member for conveying the recording medium, said conveying member having a surface for mounting the recording medium and a thickness t;

a first image recording position disposed at an image recording area;

a second image recording position disposed at the image recording area;

a drive roller member for driving said endless recording medium conveying member, said drive roller member having a diameter D; and driving means for driving said drive roller member, wherein a distance between the first and second image recording position is equal to $\pi(D+2\ t)$.

26. A recording medium conveying apparatus according to claim 24, wherein color to be recorded on the recording medium at the first image recording position has a contrast different from that at the second image recording position.

27. A recording medium conveying apparatus according to claim 25, wherein color to be recorded on the recording medium at the first image recording position has a contrast different from that at the second image recording position.

* * * * *

UNITED STATES PATENT AND TRADEMARK OFFICE

CERTIFICATE OF CORRECTION

PATENT NO. : 5,488,399

DATED : January 30, 1996

INVENTOR(S) : Tatsuo Mitomi, et al.

It is certified that error appears in the above-identified patent and that said Letters Patent is hereby corrected as shown below:

Column 7, line 60, change "A recording medium conveying apparatus" to --An image recording apparatus--;
line 63, change "A recording medium conveying apparatus" to --An image recording apparatus--; and
line 66, change "A recording medium conveying apparatus" to --An image recording apparatus--.

Column 8, line 1, change "A recording medium conveying apparatus" to --An image recording apparatus--;
line 3, change "A recording medium conveying apparatus" to --An image recording apparatus--;
line 5, change "A recording medium conveying apparatus" to --An image recording apparatus--;
line 8, change "A recording medium conveying apparatus" to --An image recording apparatus--;
line 19, change "mechanisms" to --mechanism--;
line 36, change "recording medium conveying apparatus" to --color image printing apparatus--;
line 40, change "recording medium conveying apparatus" to --color image printing apparatus--;
line 43, change "recording medium conveying apparatus" to --color image printing apparatus--; and
line 47, change "recording medium conveying apparatus" to --color image printing apparatus--.

UNITED STATES PATENT AND TRADEMARK OFFICE

CERTIFICATE OF CORRECTION

PATENT NO. : 5,488,399

DATED : January 30, 1996

INVENTOR(S) : Tatsuo Mitomi, et al.

It is certified that error appears in the above-identified patent and that said Letters Patent is hereby corrected as shown below:

Column 10, line 28, change "position" to --positions--.

Signed and Sealed this

Sixth Day of August, 1996

*Attest:*

BRUCE LEHMAN

*Attesting Officer*

*Commissioner of Patents and Trademarks*